United States Patent [19]

Jiang et al.

[11] Patent Number: 4,860,019

[45] Date of Patent: Aug. 22, 1989

[54] PLANAR TV RECEIVING ANTENNA WITH BROAD BAND

[75] Inventors: Ke-zheng Jiang; Deng-ke Ren; Zu-yuan Chen; Lian-zhen You, all of Shanghai, China

[73] Assignee: Shanghai Dong Hai Military Technology Engineering Co., Shanghai, China

[21] Appl. No.: 265,482

[22] Filed: Nov. 1, 1988

[30] Foreign Application Priority Data

Nov. 16, 1987 [CN] China ..... CN87211386

[51] Int. Cl.[4] ..... H01Q 1/38; H01Q 9/16

[52] U.S. Cl. ..... 343/795; 343/807; 343/822

[58] Field of Search ..... 343/700 MS File, 795, 343/793, 802, 803, 806, 807, 810, 812, 814, 816, 820–822, 830, 702, 727, 749, 859, 813, 860, 878, 862, 908

[56] References Cited

U.S. PATENT DOCUMENTS 4,038,662 7/1977 Turner ..... 343/802

*Primary Examiner*—Rolf Hille
*Assistant Examiner*—Michael C. Wimer
*Attorney, Agent, or Firm*—Birch, Stewart, Kolasch & Birch

[57] ABSTRACT

A TV receiving antenna with broad band and capable of connecting with a coaxial cable comprising a sheet of electrically non-conductive synthetic plastic material; a pair of antenna elements of metallic foil in the shape of substantially a triangle or a combination of a triangle and a rectangle being superimposed on one side of said sheet, a pair of frequency compensating members of snake-shaped strip line of metallic foil connected to said antenna elements respectively being superimposed on the one side of said sheet; a pair of antenna elements of metallic foil in the shape of a trapezoid or a combination of a trapezoid and a rectangle being superimposed on the opposite side of said sheet; a pair of frequency compensating members of snake-shaped strip line of metallic foil connected to said antenna elements respectively being superimposed on the opposite side of said sheet; and impedance transformers of microstrip lines of metallic foil on each side of said sheet also superimposed for matching the antenna elements and the coaxial cable. Each antenna element can have a plurality of parallel slots for the selection of polarization. The antenna can receive TV signals both in UHF and in VHF bands and eliminate ghosts. It is suitable for mass production by etching the patterns on a laminated sheet for printed circuits.

10 Claims, 5 Drawing Sheets

PLANAR TV RECEIVING ANTENNA WITH BROAD BAND

BACKGROUND OF THE INVENTION

The present invention relates generally to a high frequency antenna and more particularly to a planar TV receiving antenna having broad band and being able to be used to receive the TV signal from the lowest VHF channel to the highest UHF channel.

Recently, telescopic and Yagi-Uda antennas are used in TV sets, radio transmitter-receivers or other radio communication apparatus. When they are used for the reception of TV signals, due to the fact that the receiving channel of the antenna depends upon the dimension of the antenna, therefore after the dimension of the antenna is fixed, they are not suitable for operating on a broad band, even if the dimension of the antenna is adjustable, and such adjustment is usually very troublesome. In fact they are not able to obtain satisfactory results in the reception of TV signals for all channels, i.e. VHF channels and UHF channels. In U.S. Pat. No. 3,815,141, a planar high frequency antenna was disclosed, but this antenna can only be used in the ultra-high frequency band (UHF). This antenna comprises a sheet composed of two superimposed laminae of electrically non-conductive synthetic plastic foil material and a pair of triangular antenna elements of metallic foil sandwiched between them. A pair of triangular antenna elements are connected to the receiving apparatus directly by feed lines without any compensation, so the range of the operation frequency can't be broadened to VHF. Because an impedance transformer is not used and integrated with the antenna elements, it is impossible to output a receiving signal from the antenna by a coaxial cable, so the anti-interference performance is inferior and the practical value for usage is limited.

SUMMARY OF THE INVENTION

It is the object of the invention to provide a new fullchannel planar receiving antenna which can receive TV signals not only in ultra-high frequency (UHF), but also in very high frequency (VHF) and function to eliminate ghosts.

Another object of the invention is to provide a full-channel planar TV receiving antenna capable of connecting with a coaxial cable.

Still a further object of the invention is to provide a full-channel planar receiving antenna having a plurality of parallel slots for the selection of the polarization to further eliminate ghosts.

According to one aspect of the present invention, the antenna comprises a sheet of electrically non-conductive synthetic plastic material; a pair of substantially triangular antenna elements of metallic foil being superimposed on one side of said sheet; a pair of frequency compensating members of metallic foil connected to said triangular antenna elements respectively being superimposed on the one side of said sheet; a pair of substantially trapezoidal antenna elements of metallic foil being superimposed on the opposite side of said sheet; a pair of frequency compensating members of metallic foil connected to said trapezoidal antenna elements respectively being superimposed on the opposite side of said sheet; an impedance transformer of metallic foil superimposed on one side of said sheet being connected to one of the frequency compensating members on the one side of said sheet and corresponding frequency compensating member on the opposite side of said sheet; and the other impedance transformer of metallic foil superimposed on the opposite side of said sheet being connected to one of the frequency compensating members on the opposite side of said sheet and the corresponding frequency compensating member on the one side of said sheet.

According to the another aspect of the present invention, the antenna comprises a sheet of electrically non-conductive synthetic plastic material having one side and an opposite side; the first and the second antenna elements of metallic foil being superimposed on one side of said sheet, said elements being in the shape of a combination of a triangle and a rectangle and having respective apices of said triangles adjacent but spaced from one another and the respective bases of said triangles remote from and substantially parallel to each other and one side of said rectangle being coincident with said base of said triangle; the third and the fourth antenna elements of metallic foil being superimposed on the opposite side of said sheet, said elements being in the shape of a combination of a trapezoid and a rectangle and having respective upper edges of the trapezoids adjacent but spaced from one another and respective lower edges remote from and substantially parallel to each other, and one side of said rectangle being coincident with said lower edge; the first snake-shaped strip line of metallic foil for frequency compensation superimposed on the one side of said sheet and having one terminal connected to the apex of the first antenna element; the second snake-shaped strip line of metallic foil for frequency compensation superimposed on one side of said sheet and having one terminal connected to the apex of the second antenna element; the third snake-shaped strip line of metallic foil for frequency compensation superimposed on the opposite side of said sheet having one terminal connected to the upper edge of the third antenna element; the fourth snake-shaped strip line of metallic foil for frequency compensation superimposed on the opposite side of said sheet having one terminal connected to the upper edge of the fourth antenna element; the first impedance transformer of microstrip line of metallic foil superimposed on said one side of said sheet having one terminal connected to the other terminal of the first snake-shaped strip line and another terminal being an output terminal capable of connecting to a coaxial cable; said one terminal of the first impedance transformer being connected to the other terminal of the third snake-shaped strip line; the second impedance transformer of microstrip line of metallic foil superimposed on said opposite side of said sheet having one terminal connected to the other terminal of the fourth snake-shaped strip line and an another terminal being an another output terminal of the antenna capable of connecting to the coaxial cable; and said one terminal of the second impedance transformer being connected to the other terminal of the second snake-shaped strip line.

According to still another aspect of the present invention, the antenna has its antenna members including a plurailty of parallel slots for the selection of the polarization.

BRIEF DESCRIPTION OF THE DRAWING

FIG. 6 is a partial and enlarged schematic sectional view taken along the line B—B of FIG. 1a.

DESCRIPTION OF THE PREFERRED EMBODIMENTS

Figure 1A:
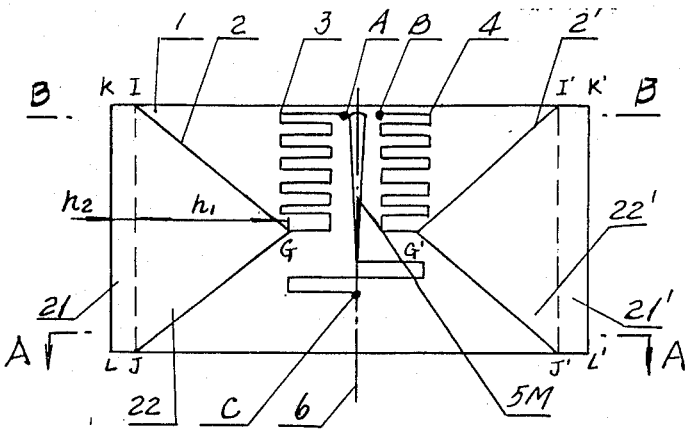
FIG. 1*a* is a front view of the first embodiment of the antenna according to the invention.
Figure 1B:
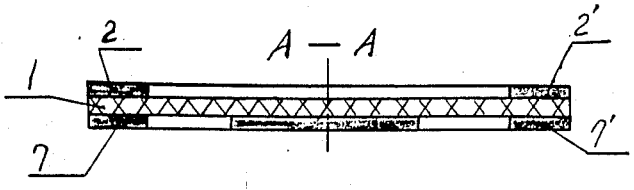
FIG. 1*b* is an A—A sectional view of FIG. 1*a;*
Figure 1C:
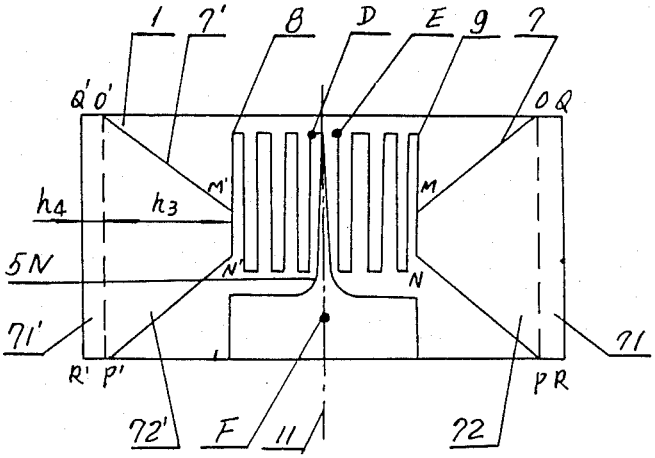
FIG. 1c is a rear view of the first embodiment of the antenna according to the invention.
Figure 6:
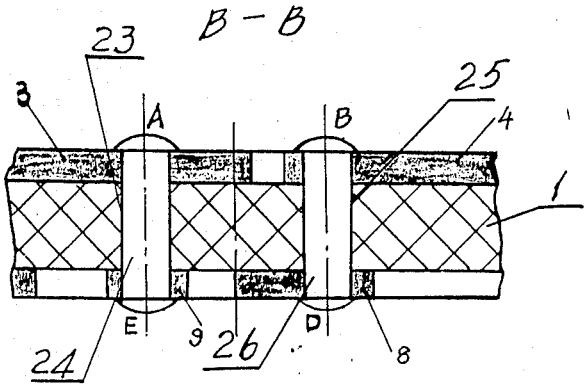

Referring to FIG. 1a, 1b and 1c, the first embodiment of the invention has been illustrated schematically. Also referring to FIG. 6, FIG. 6 is a partial and enlarged schematic sectional view taken along the line B—B of FIG. 1a. The antenna utilizes an electrically non-conductive sheet 1 made of e.g. synthetic plastic material. And the antenna members, frequency compensating members and the impedance transformers all made of metallic foil (e.g. copper foil or aluminum foil) are superimposed and laminated on two sides of the sheet 1. In the front side of the sheet 1 the antenna elements are the first antenna element 2 and the second antenna element 2'. They are the combinations of a triangle 22, 22' and a rectangle 21, 21' respectively, their respective apices G, G' of the triangles 22, 22' are adjacent but spaced from one another, and their respective bases IJ, I'J' of the triangles 22, 22' are remote from and two bases IJ, I'J' of the triangles are substantially parallel with each other. And one side of the rectangle 21, 21' is coincident with the base of the triangle 22, 22' respectively. The height of the triangle 22 on the base is $h_1$, and the height on the one side of the rectangle 21 is $h_2$, and the proportion of $h_2/h_1$ is greater than 0 and less than or equal to 0.8. 6 is an axis of symmetry in the middle of the front side of the sheet 1. The first antenna element 2 and the second antenna element 2' can be symmetric about the axis of symmetry 6. The frequency compensating member can be formed by the snake-shaped strip line. One terminal of the first antenna element 2 superimposed on the front side of the sheet 1 is connected with one terminal of the first snake-shaped strip line 3 at the apex G. One terminal of the second antenna element 2' superimposed on the front side of the sheet 1 is connected with one terminal of the second snake-shaped strip line 4 at the apex G'. The first snake-shaped strip line 3 can be also symmetric with the second snake-shaped strip line 4 about the axis of symmetry 6. 5M is the first impedance transformer connected to the other terminal A of the first snake-shaped strip line 3. The impedance transformer is a microstrip line with the width of the microstrip line varied gradually or varied in steps. The terminal C of the first impedance tranformer 5M is capable of connecting with a coaxial cable (e.g. with a core of the cable). On the rear side, the third antenna element 7 and the fourth antenna element 7' superimposed and laminated thereon are combinations of a trapezoid 72, 72' and a rectangle 71, 71' respectively. One side of the rectangle is coincident with the lower edge of the trapezoid. The height of the trapezoid 72' is $h_3$ and the height of the rectangle 71' on the opposite side of said lower edge is $h_4$. The proportion $h_4/h_3$ is greater than 0 and less than or equal to 1.2. These two antenna elements 7, 7' can be symmetric about the axis of symmetry 11 in the middle of the rear side of the sheet 1. The third antenna element 7 is connected to one terminal M of the 3rd compensating member i.e. third snake-shaped strip line 9 at the upper edge of the trapezoid 72. The fourth antenna element 7' is connected to one termnal M' of the fourth compensating member i.e. the fourth snake-shaped strip line 8. 5N is the second impedance transformer connected to the other terminal D of the fourth frequency compensating member i.e. fourth snake-shaped strip line 8, and the second impedance transformer 5N is also a microstrip line with the width of the line varied gradually or varied in steps. The terminal F of the second impedance transformer 5N is capable of connecting with a coaxial cable (e.g. the ground line of the coaxial cable). The upper edges of the third antenna element 7 and the fourth antenna element 7' are adjacent but spaced from one another and their respective lower edges are remote from each other. The connecting terminal A of the first impedance transformer 5M and the first snake-shaped strip line 3 on the front side is connected with the other terminal E of the third snake-shaped strip line 9 on the rear side by a wire or a conductor. Similarly, the connecting terminal D of the second impedance transformer 5N and the fourth snake-shaped strip line 8 on the rear side is connected with the other terminal B of the second snake-shaped strip line on the front side by a wire or a conductor. FIG. 6 shows an embodiment of the connections between terminals A and E and between terminals B and D. Holes 23 and 25 are defined respectively in the antenna at the terminals. Terminals A and E are positioned at the front side and the rear side of the sheet 1 respectively. They are connected by providing a rivet 24 made of red copper plated with silver in the hole 23. Also terminals B and D are connected by providing a similar rivet 26 in the hole 25 as a conductor. Obviously connections may be achieved by filling of tin (not shown) into the holes 23, 25 through soldering. Also connections may be achieved directly by jumper wire (not shown). It is preferable that the snake-shaped strip line 3 and 4 on the front side are perpendicular to the snake-shaped strip line 9 and 8 on the rear side respectively for the corresponding line segments of the strip lines. The third snake-shaped strip line 9 may be symmetric with the fourth snake-shaped strip line 8 about the axis 11. The function of the snake-shaped strip lines is to broaden the range of the receiving frequency. The first snake-shaped strip line 3 and the second snake-shaped strip line 4 is used mainly for the compensation in higher frequency. And the third snake-shaped strip line 8 and the fourth snake-shaped strip line 9 are used mainly for the compensation in lower frequency. Thus the antenna can not only receive the signal of ultra-high frequency (UHF), but also receive signals of very high frequency (VHF). The impedance transformer made of microstrip line of metallic foil is used to convert the balance impedance of the antenna into the unbalance impedance for the coaxial cable, and to match the antenna to the connecting coaxial cable for the TV set. In such way the antenna can output the maximum receiving signal for the TV set on one hand, and on the other hand the voltage standing wave ratio (VSWR) on the cable is decreased, thus the ghost formed by the standing wave on the feeding cable is eliminated.

The material used for the antenna may be a sheet of an electrically non-conductive synthetic plastic material covered and superimposed by the copper or aluminum foils on the two opposite sides. When the microstrip line of the impedance transformer is long, this line could be arranged in zig-zag way.

Figure 2A:
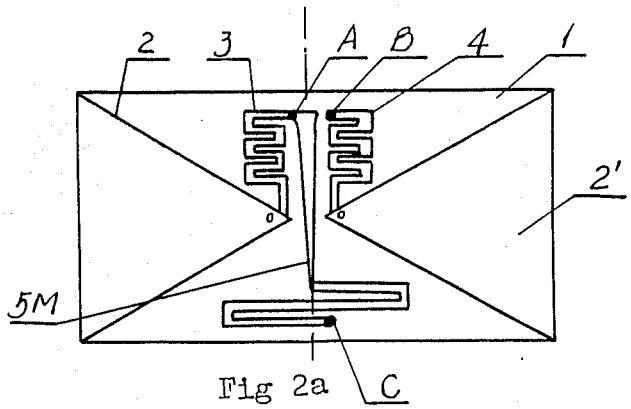
FIG. 2a is a front view of the second embodiment of the antenna according to the invention.
Figure 2B:
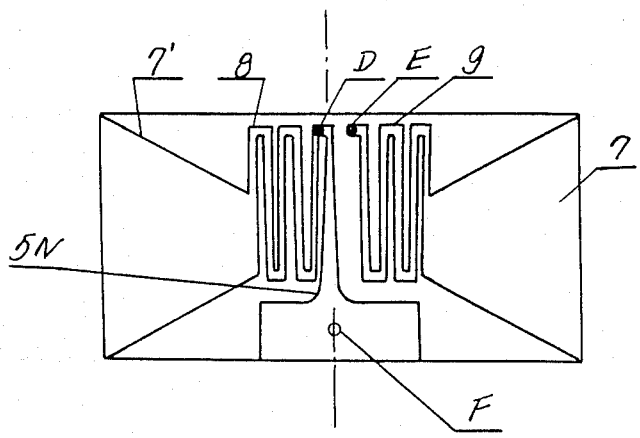
FIG. 2b is a rear view of the second embodiment of the antenna according to the invention.

Referring to FIG. 2*a*, 2*b*, the second embodiment of the invention is illustrated schematically, except for the shapes of the antenna elements, the first embodiment and the second embodiment of the antenna are all the same. In FIG. 2*a*, on the front side of the sheet 1, the shape of the first antenna member 2 and the shape of the second antenna member 2 are respectively triangles. In FIG. 2*b*, on the rear side of the sheet 1, the shapes of the third antenna member 7 and the fourth antenna member 7' are respectively trapezoids. It is equivalent to $h_2 = h_4 = 0$ in the FIG. 1.

Figure 3A:
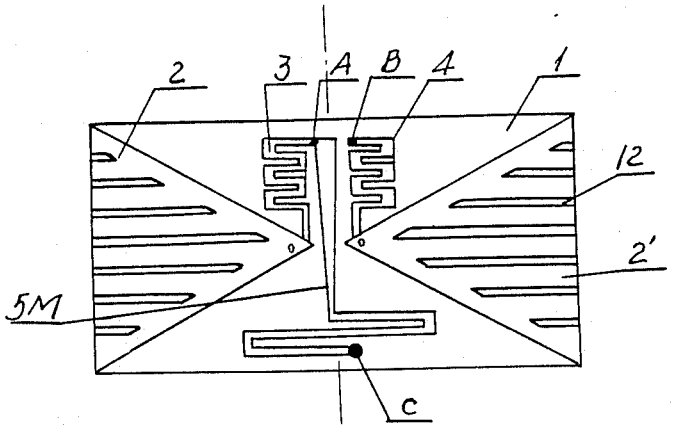
FIG. 3a is a front view of the third embodiment of the antenna according to the invention.
Figure 3B:
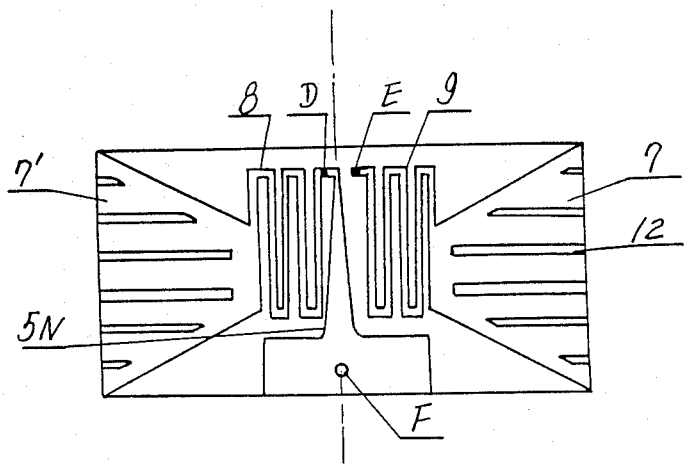
FIG. 3b is a rear view of the third embodiment of the antenna according to the invention.

Referring to FIG. 3*a* and 3*b*, the third embodiment of the invention is illustrated schematically, the difference between the first embodiment and the third embodiment lies in that on every antenna element in FIG. 3*a* and 3*b*, a plurality of the parallel slots 12 are formed in the longitudinal direction of the sheet 1 for the selection of the polarization in order to decrease the reception of the reflected waves, the direction of the polarization of which is variable, and to eliminate the ghost occured by the reflected waves.

Figure 4A:
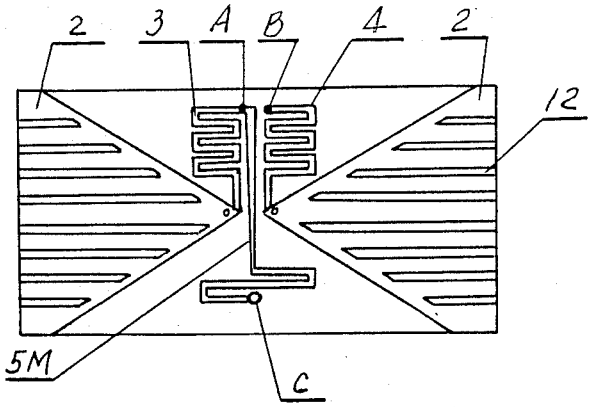
FIG. 4a is a front view of the fourth embodiment of the antenna according to the invention.
Figure 4B:
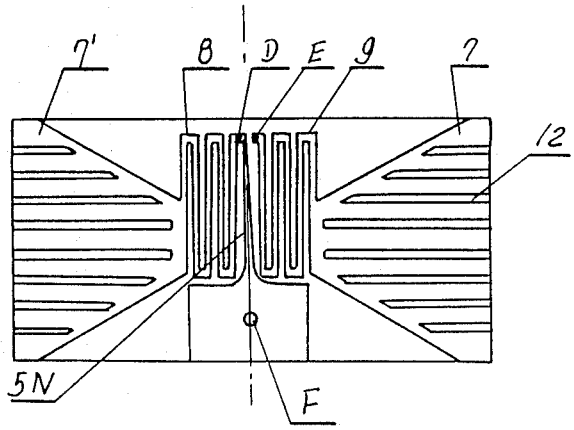
FIG. 4b is a rear view of the fourth embodiment of the antenna according to the invention.

Referring to FIG. 4*a* and 4*b*, the fourth embodiment of the invention is illustrated schematically. The difference between the second embodiment and the fourth embodiment of the invention lies in that on every antenna element in FIG. 4*a* and 4*b*, a plurality of the parallel slots 12 are formed in the longitudinal direction of the sheet 1. Their function is just as same as that mentioned in the third embodiment.

Figure 5:
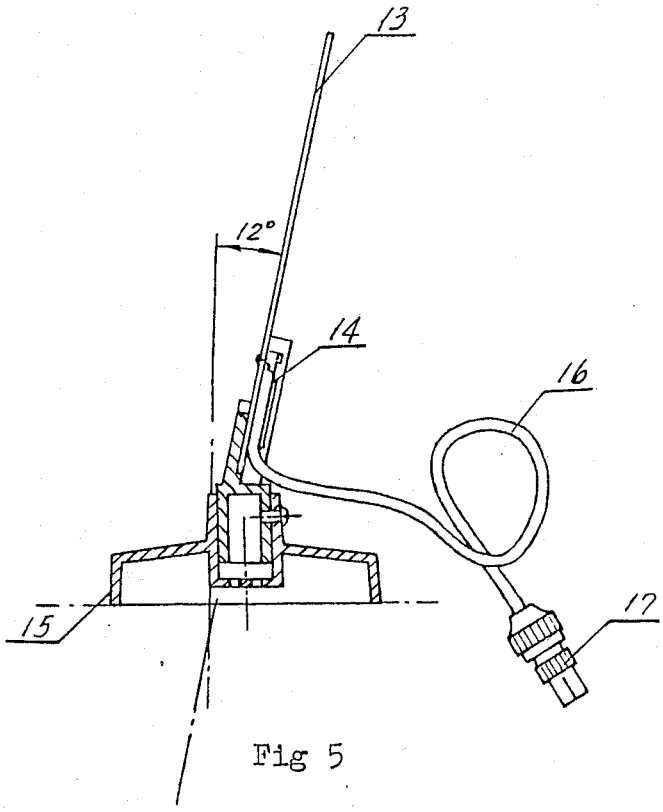
FIG. 5 is a side view of the antenna put on a supporting member mounted on a base.

Referring to FIG. 5, 13 is an antenna sheet, 15 is a base of the antenna, 14 is a supporting member of the antenna where the antenna sheet 13 could be inserted in. 16 is a coaxial cable connected to the output terminals of the antenna sheet 13. 17 is a plug of the cable 16 which could be connected with the corresponding socket on the TV set. The angle between the plane of the antenna sheet 13 and the normal to ground is $12 \pm 2$ degrees. This angle could provide a good effect for watching TV.

In each embodiment, the surface of the antenna can be sprayed with plastics or painted for protection, and the antenna sheet can be decorated with a photo or picture.

The antenna pattern on the sheet 1 can be formed on the laminated sheets for printed circuits by etching the metallic foil superimposed and laminated on the two sides of the sheet. The laminated sheets for printed circuits may be phenolic cellulose paper copper-clad laminated sheets for printed circuits, or epoxide cellulose paper copper-clad laminated sheets for printed circuits or epoxide woven glass fabric copper-clad laminated sheets for printed circuits etc, also an aluminum clad one can be also used. So the antenna can be produced by the printing method, suitable for mass production. Therefore the cost is low, and the performance of the antenna sheet is good as above-mentioned.

It is to be understood by those skilled in the art that the forgoing description is the preferred embodiments of the invention and that various changes and modifications may be made in the invention without departing from the spirit and scope thereof.

What I claim is:

1. A TV receiving antenna with broad band, and capable of connecting with a coaxial cable, comprising:

a sheet of electrically non-conductive synthetic plastic material;

a pair of substantially triangular antenna elements of metallic foil being superimposed on one side of said sheet;

a pair of frequency compensating members of metallic foil connected to said triangular antenna elements respectively and being superimposed on the one side of said sheet;

a pair of substantially trapezoidal antenna elements of metallic foil being superimposed on an opposite side of said sheet;

a pair of frequency compensating members of metallic foil connected to said trapezoidal antenna elements respectively and being superimposed on the opposite side of said sheet;

a first impedance transformer of metallic foil superimposed on the one side of said sheet and being connected to one of the frequency compensating members on the one side of said sheet and to a corresponding frequency compensating member on the opposite side of said sheet; and a second impedance transformer of metallic foil superimposed on the opposite side of said sheet and being connected to one of the frequency compensating members on the opposite side of said sheet and to a corresponding frequency compensating member on the one side of said sheet.

2. A TV receiving antenna with broad band and capable of connecting with a coaxial cable comprising:

a sheet of electrically non-conductive synthetic plastic material having one side and an opposite side;

first and second antenna elements of metallic foil being superimposed on the one side of said sheet, each of said elements being in the shape of a combination of a triangle and a rectangle and having respective apices of the triangles adjacent but spaced from one another and respective bases of the triangles remote from and substantially parallel to each other and one side of each rectangle being coincident with a base of each triangle;

third and fourth antenna elements of metallic foil being superimposed on the opposite side of said sheet, each of said elements being in the shape of a combination of a trapezoid and a rectangle and having respective upper edges of the trapezoids adjacent but spaced from one another and respective lower edges remote from and substantially parallel to each other, and one side of each rectangle being coincident with a respective lower edge;

a first snake-shaped strip line of metallic foil for frequency compensation superimposed on the one side of said sheet and having a first terminal connected to the apex of the first antenna element;

a second snake-shaped strip line of metallic foil for frequency compensation superimposed on the one side of said sheet and having a first terminal connected to the apex of the second antenna element;

a third snake-shaped strip line of metallic foil for frequency compensation superimposed on the opposite side of said sheet having a first terminal connected to an upper edge of the third antenna element;

a fourth snake-shaped strip line of metallic foil for frequency compensation superimposed on the opposite side of said sheet having a first terminal connected to an upper edge of the fourth antenna element;

a first impedance transformer of microstrip line of metallic foil superimposed on said one side of said sheet having a first terminal connected to a second terminal of the first snake-shaped strip line, and a second terminal of said first impedance transformer being an output terminal capable of connecting to the coaxial cable;

said first terminal of the first impedance transformer being connected to a second terminal of the third snake-shaped strip line;

a second impedance transformer of microstrip line of metallic foil superimposed on said opposite side of said sheet having a first terminal connected to a second terminal of the fourth snake-shaped strip line, and a second terminal of said second impedance transformer being an another output terminal of the antenna capable of connecting to the coaxial cable; and said first terminal of the second impedance transformer being connected to a second terminal of the second snake-shaped strip line.

3. The antenna according to claim 2, wherein said one side of said sheet having an axis of symmetry in the middle and said first and second antenna elements being substantially symmetrical about said axis of symmetry.

4. The antenna according to claim 2, wherein said opposite side of said sheet having an axis of symmetry in the middle and said third and fourth antenna elements being substantially symmetrical about said axis of symmetry.

5. The antenna according to claim 2, wherein said antenna elements having a plurality of parallel slots in a longitudinal direction for the selection of polarization.

6. The antenna according to claim 2, wherein said first snake-shaped strip line is substantially perpendicular to the third snake-shaped strip line for respective corresponding segments of the lines; and said second snake-shaped strip line is perpendicular to the fourth snake-shaped strip line for respective corresponding segments of the lines.

7. The antenna according to claim 2, wherein said sheet of synthetic plastic material being a phenolic cellulose paper sheet or an epoxide cellulose paper sheet or an epoxide woven glass fabric sheet; and said metallic foil being made of copper or aluminum.

8. The antenna according to claim 2, wherein said antenna being coated with plastic or paint on the surface.

9. The antenna according to claim 2, wherein said antenna being put in a supporting member and having an angle of $12 \pm 2$ degrees with respect to a perpendicular line to the ground.

10. The antenna according to claim 2, wherein $h_2/h_1$ is greater than 0 and less than or equal to 0.8, where $h_1$ is a height of at least one triangle from the base, $h_2$ is a height of at least one rectangle from the base to a side opposite to said base, and $h_4/h_3$ is greater than 0 and less than or equal to 1.2, where $h_3$ is a height of at least one trapezoid and $h_4$ is a height of at least one rectangle from the lower edge to a side opposite to the lower edge of the trapezoid.

* * * * *